US009273853B2

(12) United States Patent
Treanton et al.

(10) Patent No.: US 9,273,853 B2
(45) Date of Patent: Mar. 1, 2016

(54) LED-BASED ASSEMBLY WITH FIXATING OPTICAL BOARDS

(75) Inventors: Vincent Treanton, Lyons (FR); Vincent Jean-François Maugy, Caluire et Cuire (FR)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 260 days.

(21) Appl. No.: 13/993,418

(22) PCT Filed: Dec. 8, 2011

(86) PCT No.: PCT/IB2011/055541

§ 371 (c)(1),
(2), (4) Date: Jun. 12, 2013

(87) PCT Pub. No.: WO2012/080911

PCT Pub. Date: Jun. 21, 2012

(65) Prior Publication Data

US 2013/0258662 A1 Oct. 3, 2013

(30) Foreign Application Priority Data

Dec. 16, 2010 (EP) ..... 10306425

(51) Int. Cl.

| | |
|---|---|
| ***F21V 21/00*** | (2006.01) |
| ***F21V 19/00*** | (2006.01) |
| ***F21S 2/00*** | (2006.01) |
| ***F21V 21/005*** | (2006.01) |
| *F21Y 101/02* | (2006.01) |
| *F21Y 105/00* | (2006.01) |

(52) U.S. Cl.

CPC ..... *F21V 21/00* (2013.01); *F21S 2/005* (2013.01); *F21V 19/0035* (2013.01); *F21V 21/005* (2013.01); *F21Y 2101/02* (2013.01); *F21Y 2105/001* (2013.01)

(58) Field of Classification Search

CPC ..... F21S 2/00; F21S 2/005; F21V 19/0035; F21V 19/003; F21V 5/007; F21V 21/00; F21Y 2101/02; F21Y 2105/001

USPC ..... 362/249.02, 311.02, 235, 236, 237, 362/238, 240, 241, 242, 243, 244, 245, 246, 362/47

See application file for complete search history.

(56) References Cited

U.S. PATENT DOCUMENTS

| | | | | |
|---|---|---|---|---|
| 7,055,987 | B2 * | 6/2006 | Staufert | 362/235 |
| 7,731,391 | B2 * | 6/2010 | Messina et al. | 362/235 |
| 2004/0037077 | A1 * | 2/2004 | Showers et al. | 362/249 |
| 2007/0103939 | A1 * | 5/2007 | Huang | G02B 6/0078 362/633 |
| 2008/0037284 | A1 | 2/2008 | Rudisill | |
| 2009/0002988 | A1 | 1/2009 | Kim et al. | |
| 2009/0147173 | A1 | 6/2009 | An et al. | |
| 2009/0168399 | A1 | 7/2009 | Kim et al. | |
| 2010/0165627 | A1 | 7/2010 | Wung et al. | |
| 2011/0169429 | A1 * | 7/2011 | Ing et al. | 315/312 |

FOREIGN PATENT DOCUMENTS

| | | | |
|---|---|---|---|
| WO | 9016141 | A1 | 12/1990 |
| WO | 2008122941 | A1 | 10/2008 |

* cited by examiner

*Primary Examiner* — Robert May
(74) *Attorney, Agent, or Firm* — Meenakshy Chakravorty

(57) ABSTRACT

The invention refers to a LED-based assembly (100) comprising: —an electrical device comprising circuit boards (110-1,110-2) arranged to drive and/or supply arrays of LEDs (111-1,111-2) electrically and mechanically connected thereto; —an optical device provided onto the electrical device and comprising optical boards (120) partly mounted onto the circuit boards (110-1,110-2).

15 Claims, 4 Drawing Sheets

LED-BASED ASSEMBLY WITH FIXATING OPTICAL BOARDS

FIELD OF THE INVENTION

This invention relates to a LED-based assembly (e.g. a luminaire or a part thereof) comprising:

an electrical device with:

- a circuit board arranged to drive and/or supply an array of light emission diodes (LEDs);
- an array of LEDs electrically connected onto the circuit board;

an optical device provided onto the electrical device, in order to modify the beams emitted by the LEDs.

The invention relates to all types of LED-based assemblies, but more specifically to LED-based luminaires or part thereof.

BACKGROUND OF THE INVENTION

Several electronic and optical architectures of such LED-based assemblies have been proposed and implemented in light products or systems over the course of the last few years. Some of them struggle with cost, manufacturability and maintenance.

The cost-control, when designing a light system, is indeed becoming crucial, while in the mean time the light system performance must be optimized.

In LED-based luminaires, it is preferred to have all LEDs connected onto a single printed circuit board ("PCB") for handling and releding reasons. PCB is fixed to the chassis and optical elements, or an optical board including optical elements, are also fixed to the chassis through the PCB to cover the LEDs.

The chassis (e.g. a heat sink) has usually a clean and good-finished interface with the PCB to insure a good thermal contact. For a large-sized PCB, these requirements involve extra-costs—e.g. foundry costs.

Furthermore, a high number of types of PCBs and optics needs to be provided to comply with the various designs and specifications of LED-based systems or luminaires. This diversity of PCBs and optics can be a serious handicap in an industrial environment as a factory can end up with a shortage of useful components inducing a longer delivery lead time for the product, and the unused components may stay in stock for some time which is undesirable in a Lean environment.

SUMMARY OF THE INVENTION

The present invention provides a LED-based assembly intending to solve the aforementioned drawbacks.

In particular, a purpose of the invention is to provide a light architecture which reduces the manufacturing costs of the LED-based assemblies while maintaining or optimizing the energy and light performances of the assembly, or the luminaire comprising this assembly.

Another purpose of the invention is to make a cheaper and easier luminaire assembly.

Another purpose of the invention is to make a cheaper and easier maintenance of the luminaire, and especially the releding.

Another purpose of the invention is to facilitate the recycling of the LED-based assembly or part thereof.

In order to solve these problems and meet these purposes, the invention proposes an invention according to claim 1.

It is to be noticed that, in claim 1, M should be an integer equal to or greater than two, and N an integer equal to or greater than one.

Since each optical board is mounted onto several circuit boards, the invention allows to fix the circuit boards together, by using the optical boards as means of fixation.

Therefore this LED-based assembly does not need to be fixed to a chassis of a luminaire to be actually built, since the electrical device and the optical device are mounted one to the other into a final firm assembly as one piece, but sufficiently mechanically flexible to follow the shape of the top of the chassis (e.g. heat sink) of a luminaire, and the thermal contact with the chassis is improved accordingly.

More particularly this LED-based assembly can be mounted apart from the luminaire and assembled into the luminaire afterwards.

Therefore the factory does not need to be big enough to store and disassemble luminaires in order to make the LED-based assembly. Moreover, the possibility to manufacture in smaller factories means less needs for centralizing the production and less travels for transporting the LED-based assemblies or components thereof. This invention may therefore also decrease the emission of carbon gas by the vehicles transporting these components.

The invention facilitates therefore the montage of the luminaire at lower costs.

In the same manner, the LED-based assembly can be easily dismounted from the chassis of a luminaire (without dimounting the luminaire), to be replaced or repaired in the small factory: this makes the maintenance operations much easier and cheaper.

Moreover the invention allows to make the LED-based assembly from small building modules (a module being made of sub-assemblies of circuit boards and optical boards, i.e. at least one optical board mounted onto two circuit boards) which are used to create bigger ones: this is Lean as it goes for simplicity and ease of assembly.

Moreover the manufacturing or maintenance of the LED-based assembly is simple since it does not require specialized and expensive equipment.

Moreover, the invention is sustainable at least because, when one or a few LEDs fail, only a small part of the LED-based assembly—e.g. a LED module—is replaced and then possibly recycled. The maintenance and releding operation is therefore cheaper and more sustainable than previous solutions where the whole LED-based assembly had typically to be replaced entirely.

Furthermore this "modular" architecture permits to have a multiplicity of combinations for the LED-based assembly, leading to a freedom in the conception of the LED-based assembly and of the luminaire.

Moreover this modular architecture can be performed from similar modules, or similar circuit boards and similar optical boards. Therefore one can imagine designing different systems from circuit boards and optical boards having similar configurations and/or sizes. It would be therefore possible to standardize the types of circuit boards and optical boards to be used in LED-based assemblies, reducing accordingly drastically the number of types of circuit boards and optical boards. These boards may therefore be industrially manufactured in greater quantities, decreasing the price per piece. Moreover the management of the stock would be easier since less references have to be stored.

Optionally, the invention proposes an assembly according to claim 2.

Thus the optical board is mounted such that some LEDs of both circuit boards are left free from the optical board, giving the possibility for other optical boards to be mounted onto these free LEDs, facilitating therefore the montage thanks to a better modular architecture.

Optionally, the invention proposes an assembly according to claim 3.

In particular the width of the optical boards is roughly similar to those of the circuit boards. This configuration shows clearly that these optical boards can be offset by half the width of the circuit boards onto which they are mounted, which facilitates the montage since less markings are necessary and it is intuitively easier.

Moreover the storage and transportation of optical boards and circuit boards which are of similar sizes, is easier to perform, especially in terms of packaging.

Optionally, the invention proposes the assembly of claim 4 and/or claim 5.

These optional features of the invention show how the invention can reduce the costs of fabrication of the LED-based assemblies, since the boards can be standardized (e.g. as a single or only a few references), thus massively produced (which lower their prices per units) and make the storage easier to manage.

Optionally, the invention proposes the assembly of claim 6 or claim 7.

Moreover, the montage and dismontage of the optical boards onto the circuit boards is therefore easy to perform, and do not necessitate sophisticated tools: it is only needed to act onto the relevant zones of fixation retaining the relevant optical board(s) onto the corresponding circuit boards, to repair or mount a LED-based assembly according to the invention.

Optionally, the invention proposes an assembly according to claim 8.

This feature shows how the invention allows to build-up some large, and as one piece while mechanically flexible LED-based assembly, without need to fix the circuit boards and/or the optical boards onto a chassis or a heat sink of a luminaire. This large-scale LED-based assembly allows also a montage onto the luminaire afterwards. It also helps the manipulation and storage in the plant. Moreover the fabrication can be performed in small factories as already discussed.

Optionally, the invention proposes an assembly according to claim 9.

These narrow optical boards are provided to cover the few uncovered LEDs, e.g. once the N optical boards are mounted onto the electrical device, allowing therefore to have a full LED-based assembly, with all the LEDs having their own optical systems.

Optionally, the invention proposes an assembly with a frame according to claim 10.

This frame may protect and/or rigidify the LED-based assembly. It can also guides the montage, in the case that the invention proposes the assembly according to claim 11. The invention may propose a particular frame according to claim 12, wherein the frame has also an electrical function, which reduces the problems of encumbrances and weaknesses of the interconnections between and the supply to the circuit boards. According to claim 13, the assembly might be simplified by using a single electrical interface provided in the frame.

Optionally, the LED-based assembly comprises the electric circuitry according to claim 14.

This approach ensures that:

- All LEDs receive the same control signal, and are therefore coordinated, regardless of the number of LEDs, and have the same behavior;
- The system efficacy is optimized regardless of LEDs count;
- If the circuit boards are in a parallel configuration, only one circuit board needs to be replaced if one or several of the LEDs connected to it shut down. Possibly, the replacement can be postponed if the luminaire can continue to illuminate sufficiently—the LEDs of the other circuit boards might be driven and supplied to compensate this loss of lights: this reduces therefore the luminaire maintenance costs as the releding can be further postponed.

Today, this is usually not the case with existing LEDgine architecture where circuit boards are typically independent (i.e. one control unit is provided per circuit board) and system efficacy is low for low LED counts and high for high LED counts, bringing significant discrepancies.

Optionally, the control unit interfaces with convertor boxes via a USB type connection or regular RG cables. This insures easy plug and play assembly and maintenance.

Each convector is adapted to the circuit board LED count and has therefore an optimized power factor.

The control unit is preferably unique in the LED-based assembly so as to limit the costs. This is possible by providing said electrically parallel signal inputs to the different circuit boards.

This architecture has a highly scalable and low cost approach which makes it suitable for industrialized LED-based luminaires. It offers a complete functionality along with ease of maintenance with a very down to earth concept of small building blocks where only what is needed to support the system is used.

The use of low voltages enables to integrate this system into a wide array of luminaire shapes with limited risks.

Moreover the assembly is:

- SELV as low voltage is seen by each LED string;
- scalable: one control unit is used per LED circuit board, thus optimizing the system power factor. Only what is needed is being used;
- robust: if a LED fails in open circuit or if a solder joint fails, only one circuit board is affected and the rest of the luminaire works (due to parallel inputs);
- related to before point, this limited voltage at the driver output means that the circuit boards do not need to sustain very high voltage dielectric testing: therefore no expensive and hard to get circuit board material is needed.

Furthermore the costs are minimized since the amount of electronic components are minimized as what is present is just enough to drive the LEDs.

BRIEF DESCRIPTION OF THE DRAWINGS

Other features and advantages of the invention appear from the following detailed description of one of its embodiments, given by way of non-limiting example, and with reference to the following drawings.

DETAILED DESCRIPTION OF THE INVENTION

Figure 1:
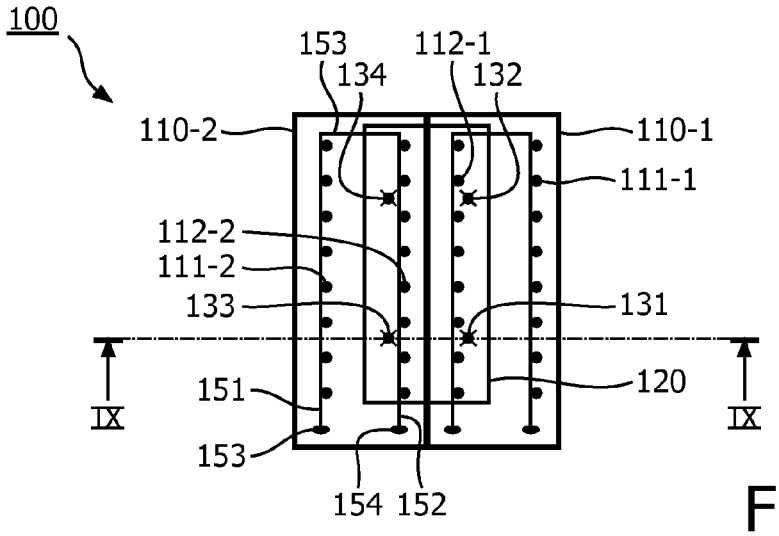
FIG. 1 shows a top and schematic view of a first LED-based assembly according to the invention.

FIG. 1 shows an example of a LED-based assembly 100 having an electrical device comprising:

two circuit boards 110-1 and 110-2;

two arrays of sixteen LEDs (one comprising LED 111-1 in a first circuit board 110-1, and the other one comprising LED 111-2 in the second circuit board 110-2) electrically connected, respectively, onto the circuit boards 110-1 and 110-2.

Each circuit board 110-1 or 110-2 might be printed circuit board (PCB) or any kind of other circuit board.

Each circuit board 110-1 or 110-2 is arranged to drive and/or supply the array of LEDs connected thereto. In this example, a circuitry (not entirely shown in this figure) is arranged such that the LEDs are in series (the electrical line of each circuit board 110-1 or 110-2 comprises in FIG. 1 an electrical input 153, a first electrical line 151 feeding a first string of eight LEDs, a second electrical line 152 feeding a second string of eight LEDS, an electrical bridge 153 between the two lines 151 and 152, and an electrical output 154). It is clear that a person skilled in the art can provide any other electrical configuration, depending on electrical/lighting requirements for the LED-based assembly. Moreover the electrical configuration of the circuit board 110-1 is not necessarily the same as the electrical configuration of circuit board 110-2, but might be different. It is indeed to be noted that the electrical configuration is not an essential feature of the invention, and that this configuration may be changed without modifying the invention.

The LED-based assembly 100 further comprises an optical device provided onto the electrical device and comprising one optical board 120 mounted onto said two circuit boards 110-1 and 110-2.

This optical board 120 is arranged to modify at least a part of the light beams emitted by the LEDs. To this purpose, this optical board may be provided with prisms, lenses, deflectors, scattering elements, and/or light-converting elements, etc. As an example, this optical board 120 may be provided with hemispherical and/or hemiparaboloid lenses, and/or with convex and/or concave diopters and/or lenses according to WO2008/122941.

Optionally, the optical device according to the invention can further comprise, in addition to the optical board 120, other components (e.g. reflectors, collimators, another optical board positioned onto the optical board 120, light-converting sheet, etc.), not shown in the FIGs.

Optionally, the width of the optical board 120 is roughly the same as half the sum of the widths of the two circuit boards 110-1 and 110-2 onto which it is mounted.

Figure 9:
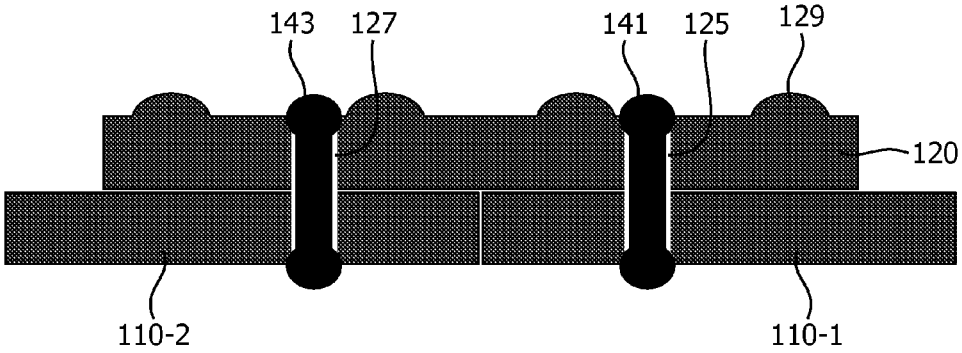
FIG. 9 shows a schematic cross-section view of the first LED-based assembly according to IX-IX plane of FIG. 1.

The optical board 120 is mounted onto the two circuit boards 110-1 and 110-2. Therefore the optical board 120 does not have only an optical function, but allows also to attach the two circuit boards 110-1 and 110-2 together. The optical board 120 can be mounted onto the two circuit boards 110-1 and 110-2 by any type of mounting means. Optionally, the optical board 120 is at least partly mounted onto the two circuit boards 110-1 and 110-2 at zones of fixation 131, 132, 133, 134 located apart from the LEDs connected to these circuit boards 110-1 and 110-2. As depicted in FIG. 9, the fixations at the zones of fixation 131 and 133 may be performed via corresponding holes 125, 127 provided through the optical board 120 and through the circuit boards 110-1 and 110-2, and rigid elements of fixation 141 and 143 (e.g. plastic rivets and/or metallic rivets and/or soldering) provided through these holes 125,127. All these exemplary options are equivalent but some can be preferred than other ones because more convenient for small factories with little assembly equipment. In particular, plastic rivets might be chosen as the easiest elements of fixation 141-143 for removal during maintenance (done without tools). Maintenance with plastic rivets can therefore be done on site (where luminaire is installed on mast) while keeping good positioning between optics and LEDs. It is to be noticed that optical elements 129 (hemispherical lenses or lenses according to WO2008/122941 in FIG. 1) are provided in the optical board 120 as depicted by FIG. 9, each optical element 129 facing or covering at least one LED.

In the embodiment depicted by FIG. 1, the optical board 120 covers sixteen LEDs (one string of eight LEDs on each circuit board 110-1 and 110-2), and does not cover sixteen other LEDs (a string of eight LEDs on each circuit board 110-1 and 110-2—comprising the LEDs 111-2 and 111-2). The person skilled in the art will clearly understand and deduce that many other configurations can be provided: indeed the number of LEDs covered or not covered by the optical board 120 should not be understood as being limited to sixteen+sixteen (respective to the circuit boards 110-1 and 110-2), and that the shape and area of the optical board 120 may be modified in order to cover different numbers of LEDs and different LEDs of the circuit boards 110-1 and 110-2. In particular an optical designer will find easily the freedom to vary the design of the optical board 120 depending on the light effects he wants to reach. For example, he might leave some LEDs uncovered by the optical board 120 in order to non-modify the light emitted by these LEDs—and may add thereon another optical element (comprised in said optical device of the LED-based assembly) covering the whole circuit boards 110-1 and 110-2 and optical board 120, such as for example a diffusing device and/or a light-converting device. Alternatively, the optical designer may provide one or two lateral narrow optical boards (not shown in FIG. 1) arranged to cover at least a part of the LEDs not covered by the optical board 120. By doing this, the designer might provide optical boards having each the same optical elements (e.g. lenses, prisms, reflectors, etc.) but different from the other optical boards: manufacturing is therefore easier and less costly (because one can manufacture industrially large-scaled optical boards having the same optical elements) and the possibilities of designs (and light effects) are increased.

Many alternative LED-based assemblies might be designed: for example, the optical board 120 might cover all the LEDs of circuit board 110-1 but only a part of the LEDs of the circuit board 110-2, or might cover different LEDs.

FIG. 2 through 8 give several configurations of optical boards, as ways of examples, that can be used in LED-based assemblies according to the invention. The montage of these optical boards might be performed in the same manner as those described in reference to FIGS. 1 and 9 (e.g. montage at zones of fixation).

Figure 2:
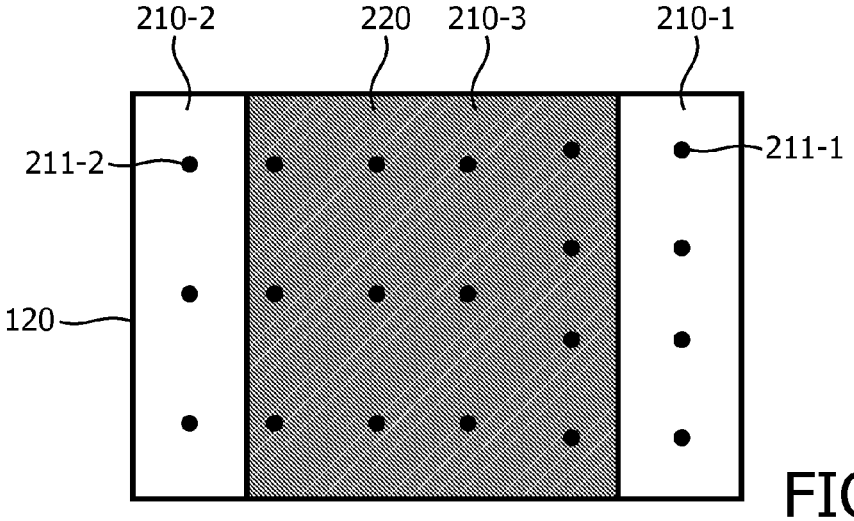
FIG. 2 shows a top and schematic view of a second LED-based assembly according to the invention.

LED-based assembly of FIG. 2 comprises three circuit boards 210-1, 210-2 and 210-3 positioned side-by-side and one optical board 220 covering entirely the central circuit board 210-1 and partly the lateral circuit boards 210-2 and 210-3 (e.g. the LEDs 211-1 and 211-2 are not covered). Optionally one or two lateral narrow optical boards (not shown in FIG. 2) are arranged to cover at least a part of the LEDs not covered by the optical board 220.

Figure 3:
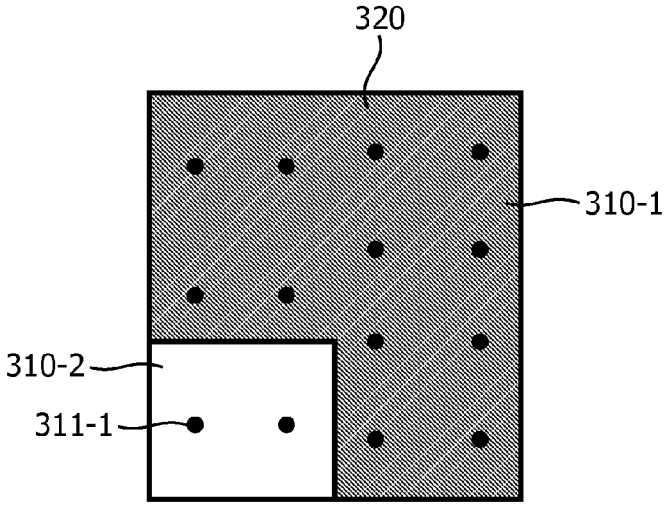
FIG. 3 shows a top and schematic view of a third LED-based assembly according to the invention.

LED-based assembly of FIG. 3 comprises two circuit boards 310-1 and 310-2 and one optical board 320 covering entirely the right circuit board 310-1 and partly the left circuit board 310-2 (e.g. the LED 311-1 is not covered). Optionally a narrow optical board (not shown in FIG. 3) is arranged to cover at least a part of the LEDs not covered by the optical board 320.

Figure 4:
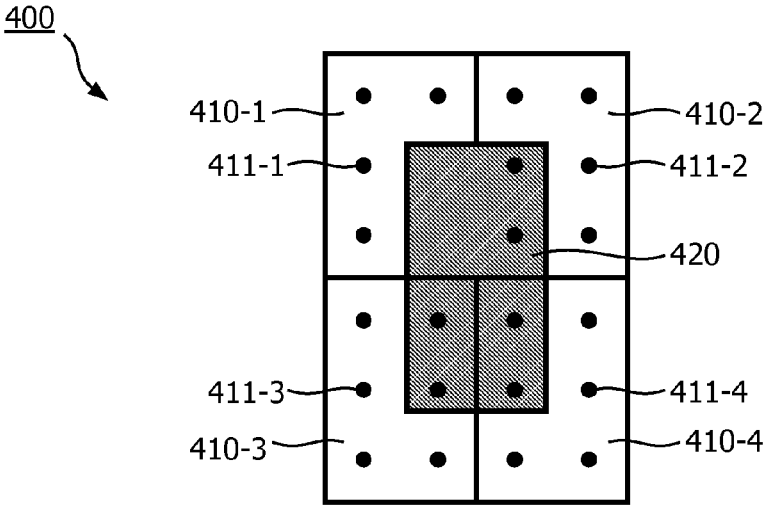
FIG. 4 shows a top and schematic view of a fourth LED-based assembly according to the invention.

LED-based assembly of FIG. 4 comprises four circuit boards 410-1, 410-2, 410-3 and 410-4 positioned to have each two adjacent circuit boards and to form a general rectangular circuit board 400. Additionally one optical board 420 is centrally positioned so as to cover partly each circuit board 410-1, 410-2, 410-3, 410-4 (e.g. the LEDs 411-1, 411-2, 411-3 and 411-4 are not covered). Optionally one, two, three or four lateral narrow optical boards (not shown in FIG. 4) are arranged to cover at least a part of the LEDs not covered by the optical board 420.

Figure 5:
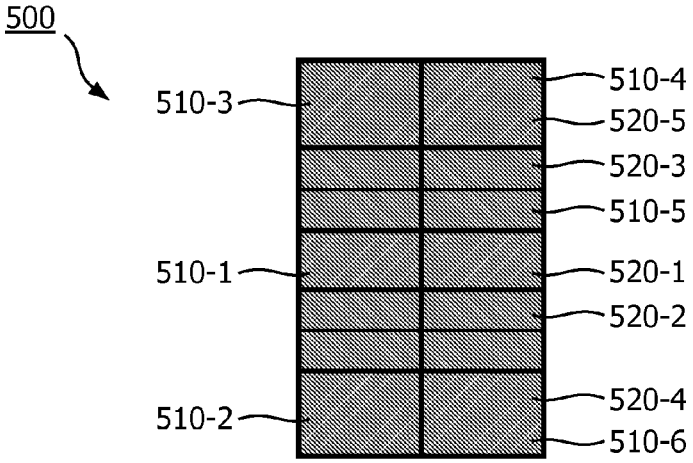
FIG. 5 shows a top and schematic view of a fifth LED-based assembly according to the invention.

LED-based assembly of FIG. 5 comprises six circuit boards 510-1, 510-2, 510-3, 510-4, 510-5 and 510-6 positioned to have each at least two adjacent circuit boards and to form a general rectangular circuit board 500. Additionally one optical board 520-1 is arranged and centrally positioned so as to cover:

entirely the width of the circuit board 500 and a part of the LEDs of the two central circuit boards 510-1 and 510-5.

Two additional optical boards 520-3 and 520-2 are arranged to cover:

entirely the width of the circuit board 500, the LEDs of the circuit boards, respectively: (i) 510-1 not covered by the optical board 520-1, and (ii) 510-5 not covered by the optical board 520-1, a part of the LEDs of, respectively: (i) the two circuit boards 510-3 and 510-4, and (ii) the two circuit boards 510-2 and 510-6.

Two further optical boards 520-5 and 520-4 are arranged to cover:

entirely the width of the circuit board 500, the LEDs not covered by, respectively: (i) the optical boards 520-1 and 520-3, and (ii) the optical boards 520-1 and 520-2.

Finally, the five optical boards 520-1, 520-2, 520-3, 520-4, 520-5 form a general optical board covering the general rectangular circuit board 500. It is to be noticed that this LED-based assembly is flexibly but firmly assembled since each of these optical boards 520-1, 520-2, 520-3, 520-4, 520-5 are mounted onto at least two circuit boards. Moreover, one may choose the same size of the optical boards 520-2, 520-3, 520-4 and 520-5, and therefore decrease the costs of manufacturing and the problems/costs of storage as aforementioned.

Figure 6:
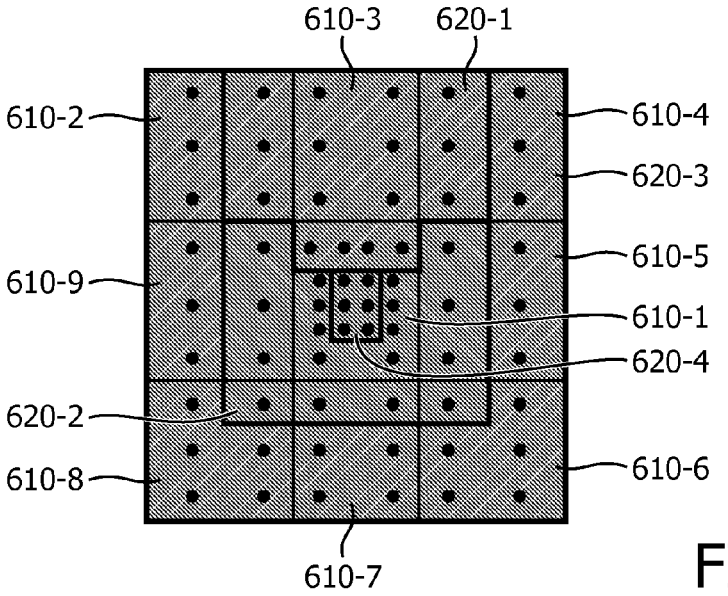
FIG. 6 shows a top and schematic view of a sixth LED-based assembly according to the invention.

LED-based assembly of FIG. 6 gives an example of optical design which does not only comprise rectangular optical boards. This assembly comprises nine circuit boards 610-1, 610-2, 610-3, 610-4, 610-5, 610-6, 610-7, 610-8 and 610-9 positioned to have one central circuit board 610-1 and eight other circuit boards 610-2, 610-3, 610-4, 610-5, 610-6, 610-7, 610-8 and 610-9 around the central circuit board 610-1 in order to form a general rectangular or squared circuit board 600. Additionally an optical board 620-1 is arranged so as to cover:

entirely the top-centered circuit board 610-3 and a part of the LEDs of the two circuit boards 610-2 and 610-4 adjacent to the top-centered circuit board 610-3;

a part of the LEDs of the central circuit board 610-1.

An additional optical board 620-2 is arranged to cover:

a part of the LEDs of the left-centered circuit board 610-9 and of the right-centered circuit board 610-5;

a part of the LEDs of the central circuit board 610-1.

a part of the LEDs of the circuit boards 610-6, 610-7 and 610-8.

A further optical board 620-3 is arranged to cover the LEDs of the circuit boards 610-2, 610-3, 610-4, 610-5, 610-6, 610-7, 610-8 and 610-9 not covered by the optical boards 620-1 and 620-2.

Optionally, a further optical board 620-4 is arranged to cover the LEDs of the central circuit board 610-1 not covered by the optical board 620-2.

Finally, the four optical boards 620-1, 620-2, 620-3 and 620-4 form a general optical board covering the general circuit board 600. It is to be noticed that this LED-based assembly is flexibly but firmly assembled since each of the optical boards 620-1, 620-2 and 620-3 are mounted onto at least two circuit boards.

The design of FIG. 6 shows how the invention can allow a light designer to design specific optical boards (e.g. by providing different optical boards, having each one the same optical elements (e.g. lenses, prisms, reflectors, etc.), but different from those of the other optical boards, bringing the aforementioned advantages) to have specific light effects (e.g. asymmetric light beams).

Moreover, this design (as well as the other designs described in this document and any design according to the invention) allows to mount the LED-based assembly first in the factory and second onto a luminaire. The same applies for the maintenance of the luminaire.

Figure 7:
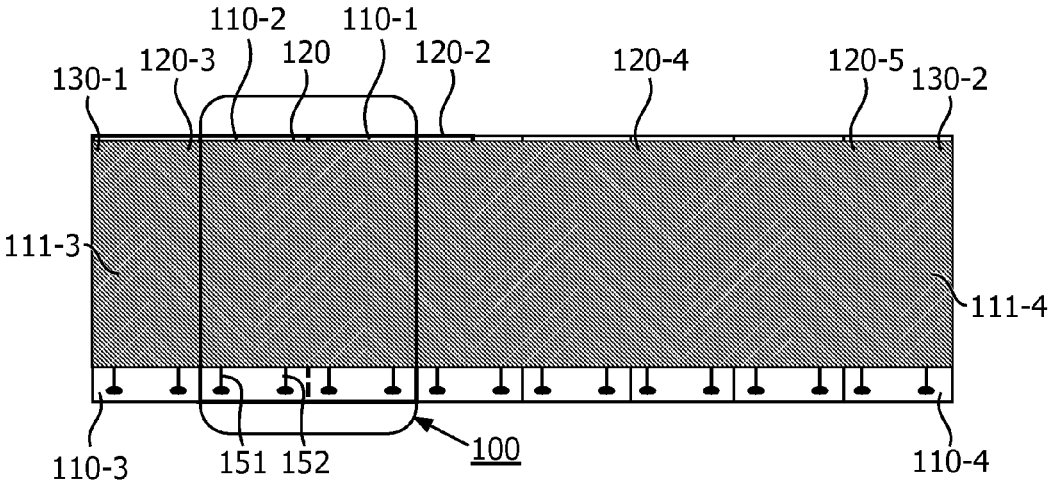
FIG. 7 shows a top and schematic view of a seventh LED-based assembly according to the invention.

LED-based assembly of FIG. 7 comprises a linear configuration of eight circuit boards (not referenced), positioned side-by-side, and partly covered with seven similar circuit boards such that only lateral LEDs connected to the two lateral circuit boards 110-3 and 110-4 of said array (and comprising LEDs referenced 111-3 and 111-4) are not covered by said optical boards. This LED-based assembly can be seen also as an array of three LED-based assemblies 100 according to FIG. 1 (said circuit boards 110-1, 110-2 and said optical board 120 of FIG. 1 can be recognized in LED-based assembly 100 of FIG. 7) positioned side-by-side and assembled one to the other by two intermediate optical boards 120-2 and 120-4. These LED-based assemblies 100 can therefore be seen as LED-based "modules" 100—and this is latter wording which will be used for illustrating FIG. 7 and FIG. 8). Moreover, two optical boards 120-3 and 120-5, similar to the other said optical boards of the modules, are positioned on each side and adjacent to the sides of the array of LED-based modules 100. Optionally, narrower optical boards 130-1 and 130-2 are positioned to cover the LEDs not covered by said optical boards, at the very end of the array of circuit boards.

Finally, the seven optical boards (plus the two optional narrower optical boards 130-1 and 130-2) of this LED-based assembly form a general optical board covering most (or the entirety) of the array of eight circuit boards. It is to be noticed that this LED-based assembly is flexibly but firmly assembled since each of these optical boards are mounted onto two circuit boards. Preferably, this configuration allows to use, for at least most of the designs, similar or identical optical boards in terms of sizes and configurations, and therefore decrease the costs of manufacturing and the problems/costs of storage as aforementioned. Moreover, this gives the possibilities to use the same kinds of optical boards for other LED-based assemblies differently designed, which give the possibility to standardize these optical boards, and also the circuit boards.

Figure 8:
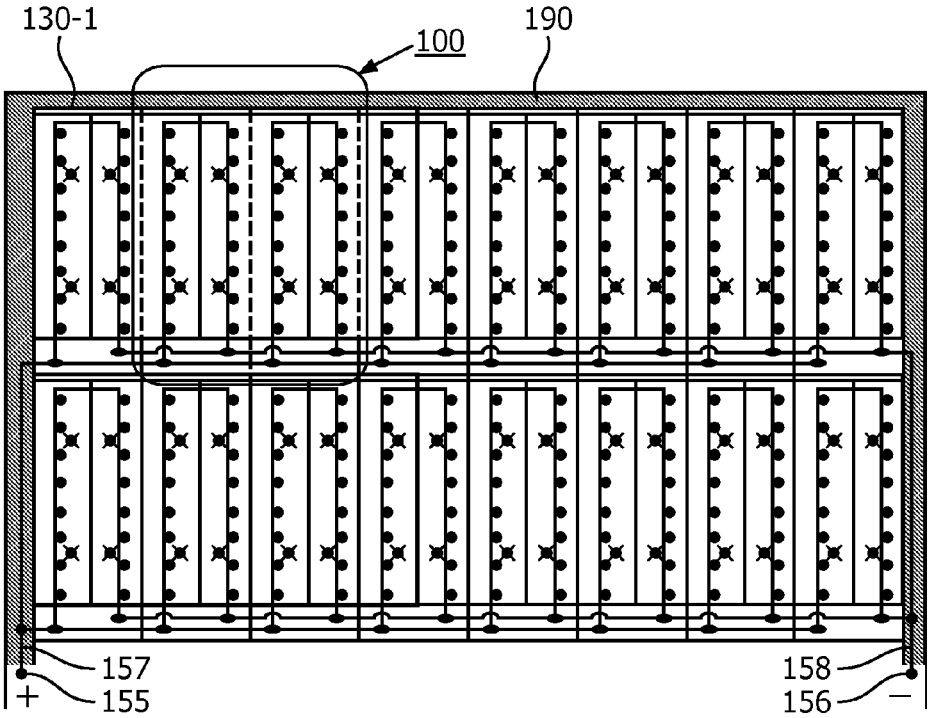
FIG. 8 shows a top and schematic view of an eighth LED-based assembly according to the invention.

LED-based assembly of FIG. 8 comprises a matrix configuration formed of two arrays according to FIG. 7 positioned side-by-side.

Electrical configuration is hereby given as way of example: the circuit boards (each comprising LEDs in series) are supplied and/or driven in parallel from general electrical lines 157 and 158. This allows to have a central and homogeneous supply and/or control of the LEDs while limiting the current lines in such a large LED-based assembly.

Figure 11:
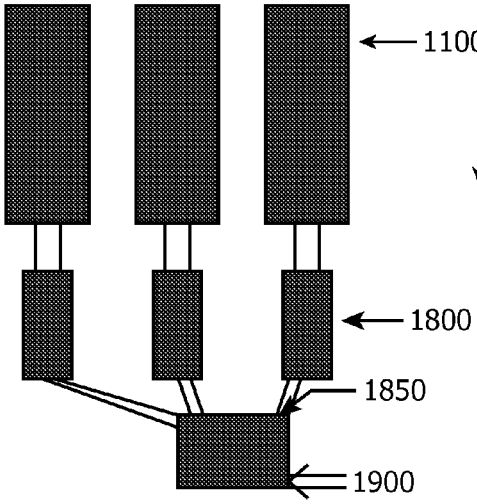
FIG. 11 shows a schematic view of an electrical control system of a LED-based assembly according to the invention.

Alternatively, the parallel supply and/or control of each circuit board can be provided in separate electrical lines, whose inputs are connected to a central control system. An example of such a control system is depicted by FIG. 11 and FIG. 12, and comprises:

- a control unit 1900 (e.g. a processor associated with a memory storing the driving data) able to control signals to the LEDs of the circuit boards 1100;
- several parallel signals outputs (ports) 1850, all connected to the control unit 1900 such that they output the same signal produced by the control unit 1900;
- converters 1800 for concerting AC to DC to power at least part of the circuit boards 1100, each converter being connected on one hand to one output of the control unit 1900 and on the other hand to an electrical input of one or several circuit boards 1100.

Figure 12:
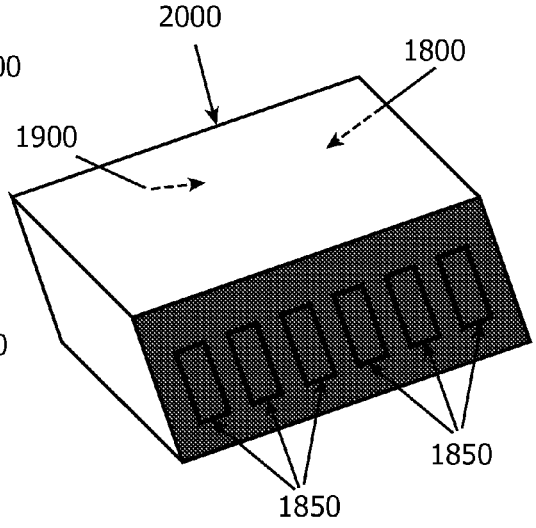
FIG. 12 shows a perspective view of an electrical control system of a LED-based assembly according to the invention.

According to FIG. 12, said control unit 1900 and converters 1800 may be embedded in a housing 2000, possibly watertight, which can protect these electrical/electronic components.

The control unit 1900 is unique in the LED-based assembly (and in the luminaire) and may contain all functionality such as CLO, current setting, all lighting regulations for dimming and interfaces with components such as OLC, SDU and Dynadimer. This control unit 1900 has several parallel outputs so to that all branches are seeing the same control information and are thus synchronized. This feature ensures that regardless of the number of LEDs, latter receive the same information and have therefore the same behavior. This control unit 1900 may interface with the convertor 1800 via a USB type connection or regular RG cables or any other types of connection. This insures easy plug-and-play assembly and maintenance.

Circuit boards 1100 are then interfaced to the control unit 1900 via converters 1800, preferably one per circuit board. The transformation performed by each converter 1800 is adapted to the associated circuit board LED count and capacities and has therefore an optimized power factor, which is an important parameter in LED luminaires. This component can either be plugged onto the control unit 1900 via a USB port or be onboard the circuit board.

Figure 10:
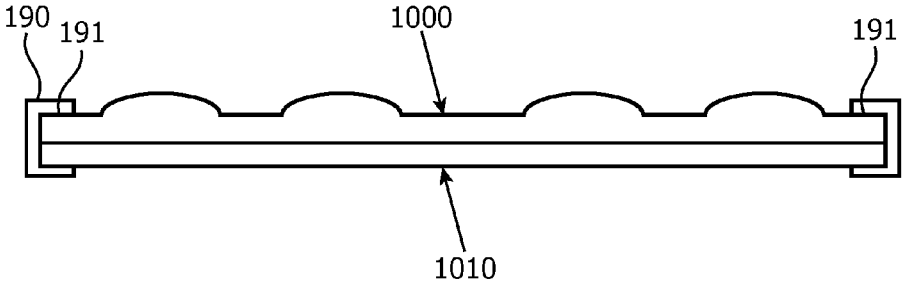
FIG. 10 shows a schematic side view of a LED-based assembly comprising a frame or rail according to the invention.

Optionally, the invention proposes a LED-based assembly further comprising a frame 190 around or a rail 190 on the sides of said electrical device (comprising said circuit boards) and said optical device (comprising said optical boards), as depicted by FIGS. 8 and 10.

This frame or rail 190 may protect and/or rigidify the LED-based assembly. It can also guides the montage, in the case that inner opposite surfaces of the frame or rail 190 are provided with notches 191 in which the electrical device 1010 and/or optical device 1000 can slide. According to FIG. 8, this frame or rail 190 may be provided with electrical connections 157-158 between at least a part of the circuit boards: in this case the frame or rail 190 has also an electrical function, which reduces the problems of encumbrances and weaknesses of the interconnections between and the supply to the circuit boards. Moreover the frame or rail 190 offers additional protection to these electrical connections. Furthermore the frame or rail 190 may comprise a single electrical interface 155-156 used for supplying and/or controlling the circuit boards.

Any LED-based assembly might be integrated in a more complicated or more rigid LED-based luminaire, for example by fixing the LED-based assembly onto the chassis or a heat sink of such a luminaire. It is to be noticed that the frame or rail 190 may help to perform this integration.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality.

The invention claimed is:

1. An LED-based assembly comprising:

an electrical device comprising:

a plurality of circuit boards arranged to drive and/or supply an array of LEDs;

a plurality of arrays of LEDs electrically connected, respectively, onto the circuit boards;

an optical device provided onto the electrical device and comprising a plurality of optical boards, each one of said optical boards being mounted onto at least two of said circuit boards such that some LEDs of an array of LEDs connected to said at least two circuit boards are not covered by the optical board.

2. The assembly according to claim 1, wherein at least one among the optical boards is mounted onto at least two of said circuit boards such that some LEDs of each array of LEDs connected to the at least two circuit boards are not covered by this optical board.

3. The assembly according to claim 1, wherein each one of said circuit boards and said optical boards exhibits width, length and thickness, and wherein the width of each one of the optical boards is approximately the same as half the sum of the widths of the at least two circuit boards onto which it is mounted.

4. The assembly according to claim 1, wherein the circuit boards have substantially the same dimensions.

5. The assembly according to claim 1, wherein the optical boards have substantially the same dimensions.

6. The assembly according to claim 1, wherein the at least one of said optical boards is at least partly mounted onto circuit boards at zones of fixation located apart from the LEDs connected to these circuit boards.

7. The assembly according to claim 6, wherein the fixations at the zones of fixation are performed via one or a combination of the following means of fixation:

holes provided through the optical board and through the circuit board, and a rigid element of fixation provided through these holes;

soldering.

8. The assembly according to claim 1, wherein said circuit boards are positioned side by side to form a main electrical board, and wherein said optical boards are positioned side by side to form a main optical board.

9. The assembly according to claim 1, further comprising narrow optical boards covering at least a part of the LEDs not covered by the optical boards.

10. The assembly according to claim 1, further comprising a frame around the electrical device and the optical device.

11. The assembly according to claim 10, wherein some inner opposite surfaces of the frame are provided with notches in which the electrical device and/or optical device can slide.

12. The assembly according to claim 10, wherein the frame comprising electrical connections between at least a part of said M circuit boards.

13. The assembly according to claim 12, wherein the frame comprising a single electrical interface used for supplying and/or controlling the M circuit boards.

14. The assembly according to claim 1, further comprising a single control unit comprising:

a control unit able to control signals to the LEDs of the circuit boards;

several parallel signals output, all connected to the control unit such that they output the same signal produced by the control unit;

converters, each converting output signals to power, each converter being connected on one hand to one output of the control unit and on the other hand to an electrical input of one or several circuit boards.

15. An LED-based assembly comprising:

an electrical device comprising:

a plurality of circuit boards arranged to drive and/or supply an array of LEDs;

a plurality of arrays of LEDs electrically connected, respectively, onto the circuit boards; and an optical device provided onto the electrical device and comprising a plurality of optical boards, each one of said optical boards being mounted onto at least two of said circuit boards such that some LEDs of an array of LEDs connected to said at least two circuit boards are not covered by the optical board;

wherein each of the optical boards are mounted onto at least two adjacent circuit boards, each of the at least two adjacent circuit boards having zones of fixation working in conjunction with the optical boards and a plurality of rigid elements of fixation to attach the at least two adjacent circuit boards together.

* * * * *